United States Patent [19]

Yamada

[11] Patent Number: 4,816,866

[45] Date of Patent: Mar. 28, 1989

[54] IMAGE PROCESSING APPARATUS

[75] Inventor: Masanori Yamada, Kawasaki, Japan

[73] Assignee: Canon Kabushiki Kaisha, Tokyo, Japan

[21] Appl. No.: 51,239

[22] Filed: May 12, 1987

Related U.S. Application Data

[63] Continuation of Ser. No. 674,549, Nov. 26, 1984, abandoned.

[30] Foreign Application Priority Data

Nov. 25, 1983 [JP] Japan ..... 58-222621
Nov. 25, 1983 [JP] Japan ..... 58-222622

[51] Int. Cl.[4] ..... G03G 21/00

[52] U.S. Cl. ..... 355/14 R; 355/3 R; 355/55

[58] Field of Search ..... 355/3 R, 14 R, 14 C, 355/14 CU, 55

[56] References Cited

U.S. PATENT DOCUMENTS 4,302,098 11/1981 Kan et al. ..... 355/14 R X
4,412,735 11/1983 Tsukata et al. ..... 355/14 C X
4,419,006 12/1983 Nagashima et al. ..... 355/14 C X
4,477,178 10/1984 Furuichi et al. ..... 355/14 C X
4,494,861 1/1985 Tachika et al. ..... 355/14 R
4,502,080 2/1985 Tsuda ..... 358/256

*Primary Examiner*—Fred L. Braun
*Attorney, Agent, or Firm*—Fitzpatrick, Cella, Harper & Scinto

[57] ABSTRACT

A console section in an image processing apparatus such as a copier, facsimile or the like. has: an image processing unit; a starting unit for starting processing by the image processing unit; a unit for selecting the process steps of the image processing unit; and a display for flickeringly displaying that the process steps are being selected and that starting by the starting unit is not permitted while the process steps are being selected by the selecting unit. This display can display the kind of process step which is selected. At least the copy quantity and variable magnifications in the main-scan and sub-scan directions of an original which are inputted by ten-keys can be switched and displayed by the display.

13 Claims, 14 Drawing Sheets

| | |
|---|---|
| FIG. 8A | |
| FIG. 8B | |
| FIG. 8C | |

IMAGE PROCESSING APPARATUS

This application is a continuation of application Ser. No. 674,549 filed Nov. 26, 1984, now abandoned.

BACKGROUND OF THE INVENTION

1. Field of the Invention

The present invention relates to an image processing apparatus such as a copier, facsimile or the like and, more particularly, to a console section for such an apparatus.

2. Description of the Prior Art

Conventionally, as an image processing apparatus, for example, as a copier, an apparatus which simply reproduces an original with high fidelity has been known. However, copiers with multiple functions have recently been provided and there have been proposed various machines having an automatic paper feed apparatus and a variable power function with fixed magnifications; a stepless variable power function or automatic variable power function; and a variable power function with different magnifications in the main-scan and sub-scan directions. In such machines, complicated operations are needed to set the mode and the like, and in the case where keys and display sections corresponding to the respective operations are provided, there are the drawbacks that the console section increases greatly in area and cost, and its operability deteriorates.

SUMMARY OF THE INVENTION

In consideration of the above-mentioned points, it is an object of the present invention to eliminate the foregoing drawbacks and to provide an image processing apparatus having a console section with a high operating efficiency.

In consideration of the above-mentioned points, it is an object of the invention to provide an image processing apparatus in which a paper quantity indicator indicates that the paper quantity cannot be set during the time interval when a magnification is being set using ten-keys, thereby enabling the user to easily grasp the state of the machine.

In considration of the above-mentioned points, it is an object of the invention to provide an image processing apparatus comprising: processing means for performing an image process; starting means for starting the image processing by this processing means; selecting means for selecting a processing step to be performed by the processing means; and display means for displaying an indication that the operation of the starting means cannot be accepted before completion of the selection by the selecting means.

In consideration of the above-mentioned points, it is an object of the invention to provide an image processing apparatus comprising: variable power means which can respectively independently change the magnifications in the main-scan and sub-scan directions; and means for allowing a common display to switch and display the respective magnifications in the main-scan and sub-scan directions according to that variable power means.

BRIEF DESCRIPTION OF THE DRAWINGS

FIGS. 7-1 and 7-2 are flow charts showing an automatic variable power mode;

DETAILED DESCRIPTION OF THE PREFERRED EMBODIMENTS

Figure 1:
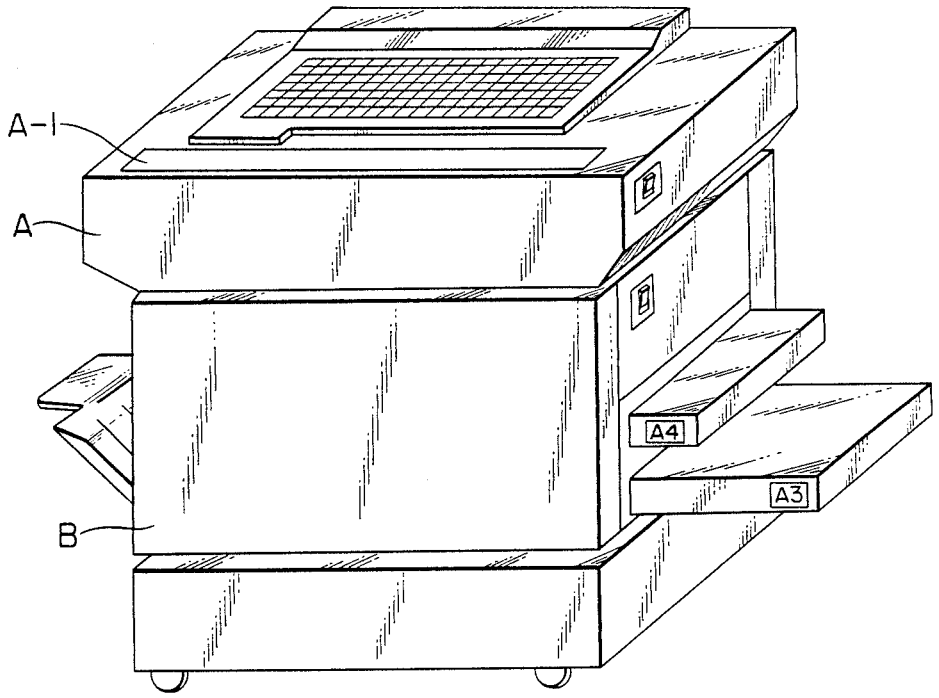
FIG. 1 is an external view of a copier in embodiment.

FIG. 1 shows an external view of a copier according to the present invention.

This apparatus is fundamentally constituted by two units a reader A and a printer B. These reader and printer are mechanically and functionally separate and each of them can be used along. They are connected through only an electrical cable. The reader A is equipped with a console section A-1, which will be explained in detail later.

Figure 2:
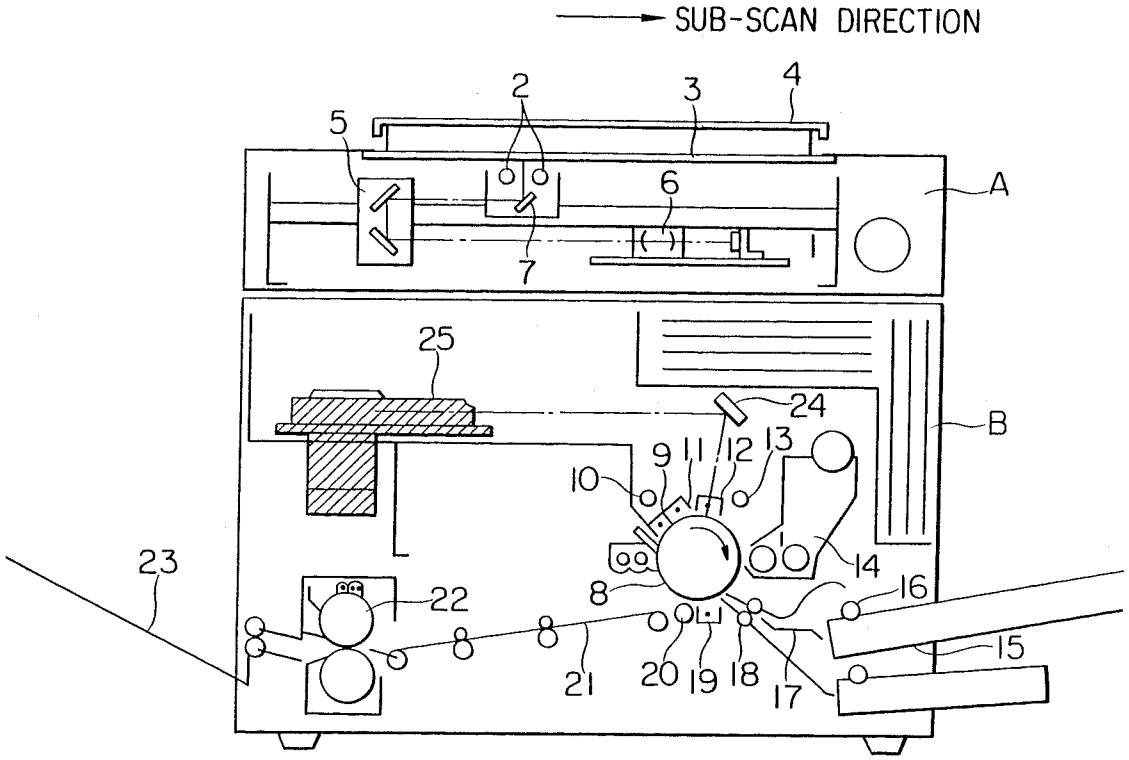
FIG. 2 illustrates a cross sectional view of the copier of FIG. 1.

FIG. 2 illustrates a cross sectional view showing structures of the reader A and printer B. An original is placed upside down on an original glass 3 and its mounting reference position is located on the left back side when the apparatus is seen from the front side. The original is pressed onto the original glass by an original cover 4. The original is illuminated by a fluorescent lamp 2 and an optical path is formed in such a manner that the reflected light is focused onto the surface of a CCD 1 through mirrors 5 and 7 and a lens 6. These mirrors 7 and 5 can be moved at relative velocities of 2:1. This optical unit is moved from the left to right at a constant speed while applying a PLL servo control by a DC servo motor. This moving velocity is set to 180 mm/sec at the equal magnification in the forward path while the original is being illuminated and is always set to 630 mm/sec in the returning backward path. The resolution power in the sub-scan direction is 16 lines/mm. The size of original which can be processed is up to A5 to A3.

Next, with respect to the main-scan direction, the main-scan width is up to 297 mm (the breadth or width of A4 size) in dependence upon the direction in that the original is placed. As the number of bits of a CCD, 4752 ($=297\times16$) bits are needed to obtain the resolution of 16 pel/mm; therefore, in this apparatus, two CCD array sensors each having 2688 bits are used and they are driven in parallel. Thus, the main scan period (that is, the accumulating time of the CCD) becomes $$T=\frac{1}{v\cdot n}=\frac{1}{180\times16}=347.2\ \mu\text{sec}$$

under the conditions of 16 lines/mm and 180 mm/sec. The image transfer speed (frequency) of the CCD becomes $$f=\frac{N}{T}=\frac{2688}{347.2\ \mu\text{sec}}=7.7419\ \text{MHz}.$$

The construction of the printer which is placed under the reader will now be described with reference to FIG.

2. The bit-serial image signal processed by the reader section is inputted to a laser scan optical system unit 25 of the printer. This unit comprises a semiconductor laser, a collimator lens, a rotating polyhedron mirror, an F$\theta$ lens, and a correction optical system. The image signal from the reader is applied to the semiconductor laser and this electrical signal is converted to the optical signal. The laser beam generated from the semiconductor laser is rearranged as parallel light by the collimator lens and is irradiated onto the polyhedron mirror which is rotating at a high speed, thereby scanning the laser beam on a photo sensitive material 8. The rotating speed of the polyhedron mirror is set to 2600 r.p.m. The scan width is about 400 mm and the effective image width is 297 mm, which is the breadth dimension of the A4 size. Therefore, the frequency of the signal which is applied to the semiconductor laser at this time becomes about 20 MHz. The laser beam generated from this unit enters the photo sensitive material 8 by way of a mirror 24.

The photo sensitive material 8 consists of, for example, three layers including a conductive layer, a photo sensitive layer and an insulative layer. Therefore, process components to enable an image to be formed on the photo sensitive material 8 are arranged for this material 8. A reference numeral 9 denotes a pre-deelectrifier; 10 a pre-deelectrifying lamp; 11 a primary electrifier; 12 a secondary electrifier; 13 a front exposing lamp; 14 a developing apparatus; 15 a paper feed cassette; 16 paper feed rollers; 17 a paper feed guide; 18 resist rollers; 19 a transfer electrifier; 20 separating rollers; 21 a carrier guide; 22 a fixing apparatus; and 23 a tray. The speeds of the photo sensitive material 8 and carrier system are set to 180 mm/sec.

The console section A-1 will now be explained with reference to FIG. 6.

Figure 6:
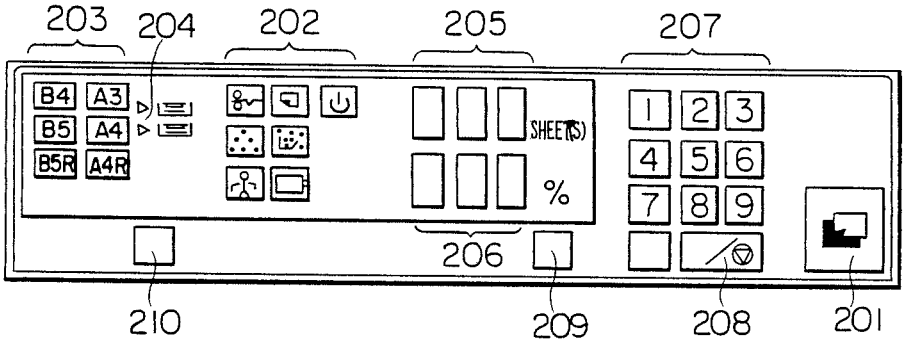
FIG. 6 is an explanatory diagram of a console section.

FIG. 6 is an explanatory diagram of the console section, in which a numeral 201 denotes an ordinary copy start key; 202 alarm indicators; 203 cassette size indicators; 204 cassette selecting stage indicators; 210 a cassette stage selecting key; 205 a copy quantity display section; 206 a magnification display section which will be described in detail later; 209 a mode key to select the variable power mode; 207 ten-keys; and 208 a clear and stop key.

Figure 3A:
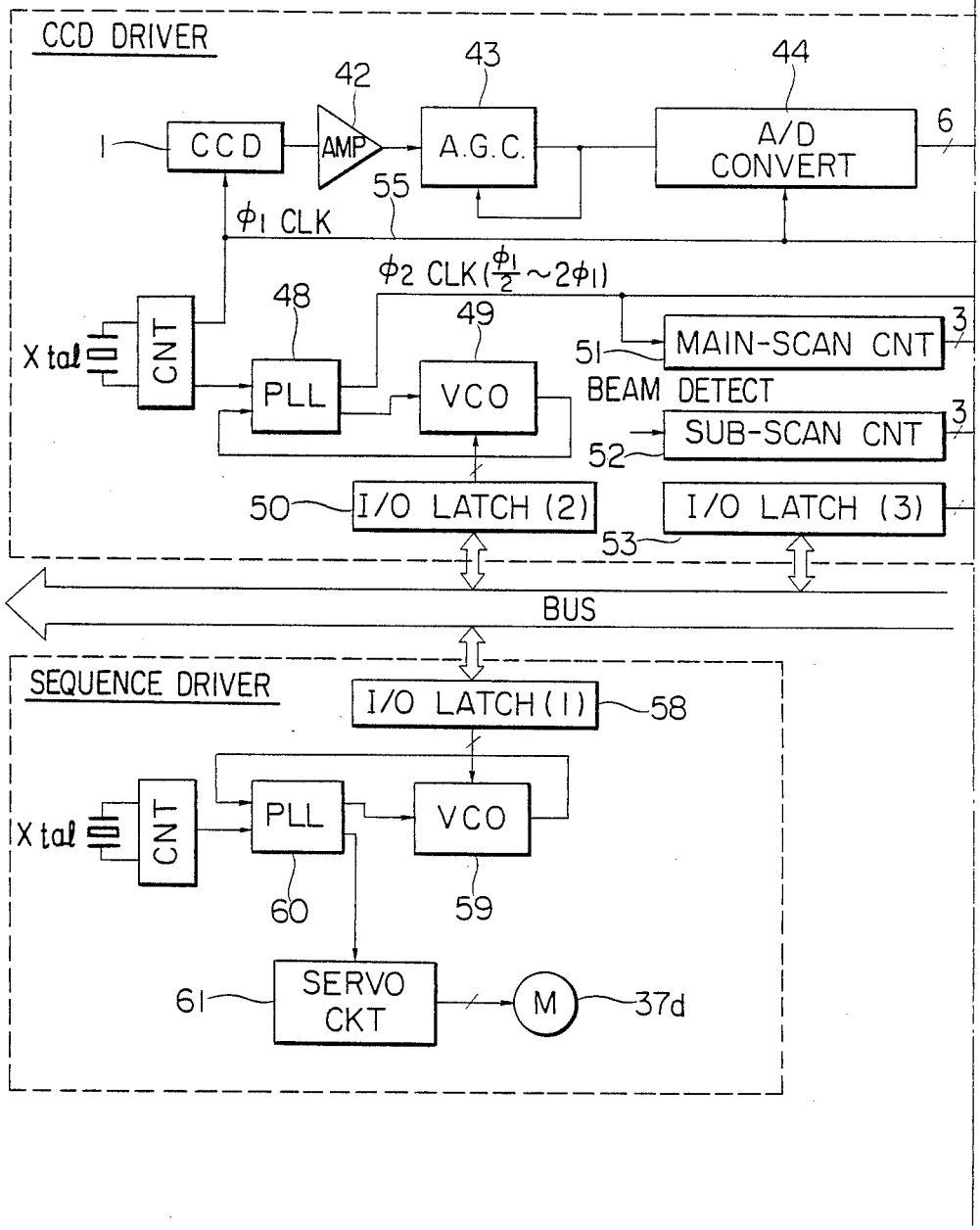
FIG. 3, composed of FIGS. 3A and 3B, is a block diagram showing a variable power function.
Figure 3B:
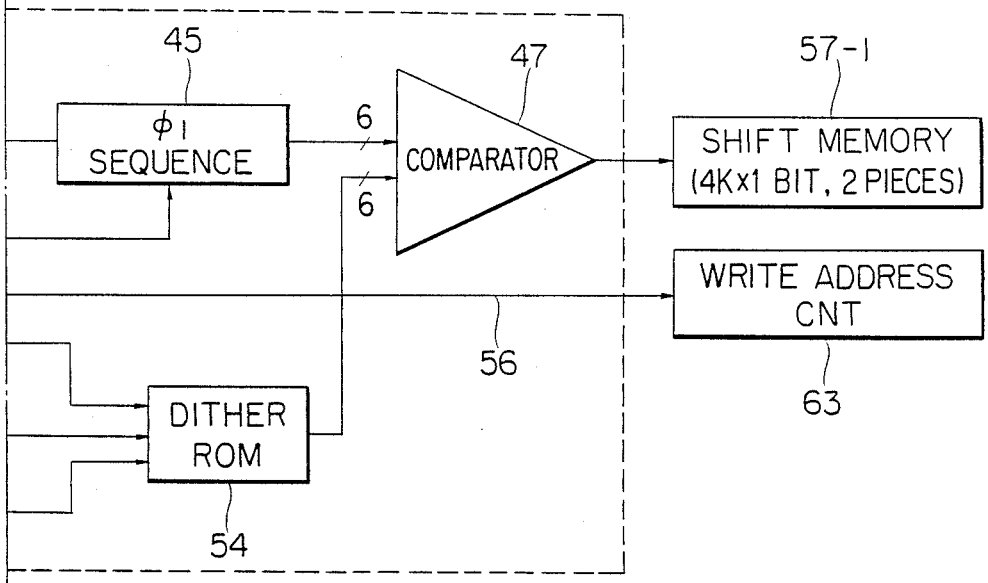
Figure 3:
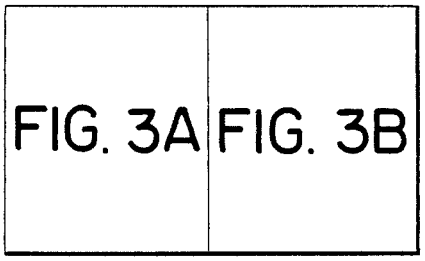

Next, a method of magnifying/reducing an original image will be explained with reference to FIG. 3. The fundamental concept of variable power is to make the rotating speed of a DC servo motor 37*d* variable with respect to the sub-scan direction. A CPU calculates the speed on the basis of the magnification inputted through a key and further calculates the PLL frequency corresponding to this speed and presets this data in an I/O latch (1) 58 prior to scanning. A certain fixed value is set for the backward path, thereby returning the optical system at a high speed. This operation is performed by presetting the value stored in the ROM of the CPU into the I/O latch (1). Therefore, when the image on an original is magnified twice as large as the inherent original size, the optical system is moved at half the speed (180 mm/sec) used for equal magnification. On the other hand, when the image on an original is reduced to one half, the optical system is moved at double speed. The main scan is the method whereby the serial signal (after A/D conversion) of the CCD which is outputted at a constant frequency is sampled at a clock rate selected responsive to the magnification. For instance, in case of double magnification, if the serial signal is sampled at a clock rate that is twice the clock rate of the CCD, data which is increased by one bit with regard to one bit of the source information will be obtained (i.e., twoce as many bits are obtained). In the case of one-half reduction, if the signal is sampled at a clock rate that is one half of the CCD clock rate, data which is decreased by one bit with respect to two bits of the source information will be derived. The CPU calculates this clock rate on the basis of the input magnification and sets it in an I/O latch (2) 50 before the sub-scan is started. As described above, although the CCD is constituted of 2688 bits, it includes thirty-six dummy bits and 2592 significant bits 2592. The driving frequency of the CCD is 7.7419 MHz and its signal line is a $\phi_1$ clock line 55. With respect to the clock for variable power, the frequency signal which is oscillated by a voltage controlled oscillator (VCO) 49 on the basis of the value stored in the I/O latch (2) 50 is synchronized with the same source oscillation as the $\phi_1$ by a PLL 48, thereby obtaining a $\phi_2$ clock and forming a variable frequency.

The recognition of the position of an original will now be explained.

Figure 4:
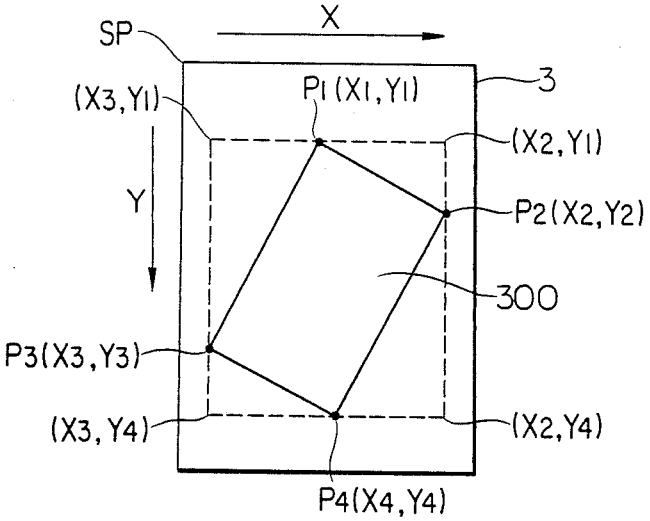
FIG. 4 is a diagram for explaining an original recognizing function.

FIG. 4 shows an original 300 placed on the original plate glass 3 of the reader A. In this kind of apparatus, the placing position is determined in principle, but there will be no problem even if the original is obliquely placed, as shown in the diagram. In this case, it is assumed that the main-scan direction is X and the sub-scan direction is Y from reference coordinates SP on the original plate, and the coordinates $P_1(X_1, Y_1)$, $P_2(X_2, Y_2)$, $P_3(X_3, Y_3)$, and $P_4(X_4, Y_4)$ of four points are detected by pre-scanning the optical system during the interval of the pre-rotating operation of the printer. This enables the size and position of the original to be determined. Due to this, the scan stroke of the scanner during the multi-copying operation can be decided and a desired original cassette can be selected. The original cover 4 (FIG. 2) is mirror-processed such that the image data for the area exterior to where the original is placed is black data. In the pre-scanning operation, the main scan and sub-scan are performed to scan the whole glass surface area, and thereafter the scan for printing is carrier out. The sub-scan velocity is faster than that used for printing.

Figure 5:
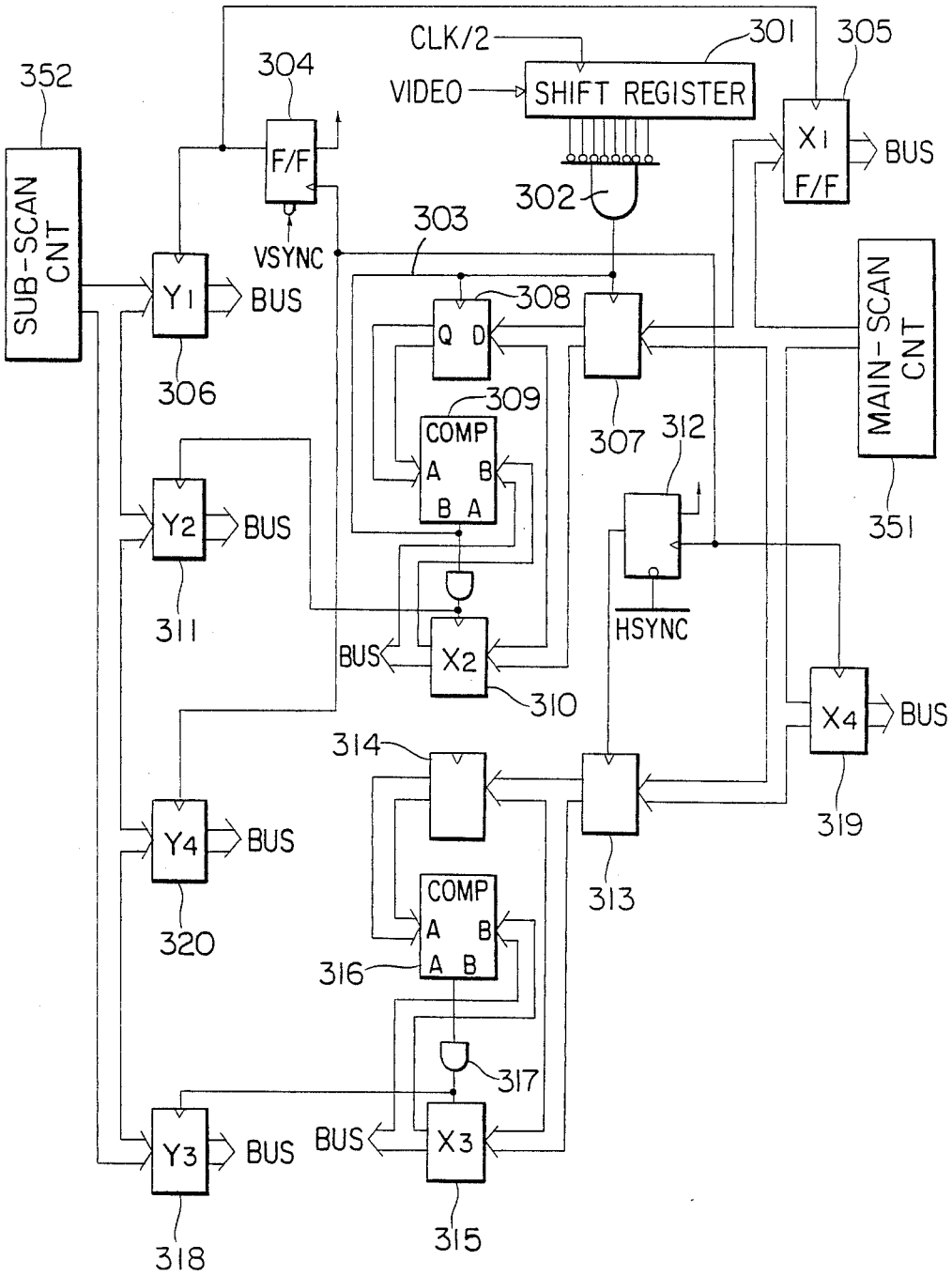
FIG. 5 is a block diagram showing the original recognizing function.

FIG. 5 is a circuit diagram showing the logic to detect the foregoing coordinates. Image data VIDEO which was binary coded by the pre-scan is inputted to a shift register 301 on an eight-bit unit basis. Upon completion of the 8-bit input, a gate circuit 302 checks to see if all of the 8-bit data represent white image or not. If the answer is "yes", the gate circuit 302 outputs a signal of 1 onto the signal line. After the scan of the original has started, an F/F 304 is set when the first eight bits are indicative of white image. This F/F has been preliminarily reset in response to a VSYNC (image head signal). Thereafter, the F/F is held set until the next VSYNC is generated. When the F/F 304 is set, the value of a main-scan counter 351 (main-scan counter 51 in FIG. 3 or a dedicated counter) at that time is loaded into a latch F/F 305. This value becomes the $X_1$ coordinate value. The value of a sub-scan counter 352 (sub-scan counter 52 in FIG. 3 or a dedicated counter) at that time is loaded into a latch 306. This value becomes the $Y_1$ coordinate value. Thus, the coordinates $P_1(X_1, Y_1)$ are obtained.

The value from the main-scan counter is loaded into a latch 307 whenever a 1-signal is outputted as a signal on line 303. This value is stored in a latch 308 immediately (until the next eight bits are stored in the shift register 301). When the value from the main-scan counter when the first eight bits are indicative of white image is loaded into the latch 308, it is compared with the magnitude of the data in a latch 310 (which has been set to "0" when the VSYNC was generated) by a comparator 309. If the data in the latch 308 is larger than the data in the latch 310, the data in the latch 308, namely, the data in the latch 307 will be loaded into the latch 310. In addition, at this time, the value of the sub-scan counter is loaded into a latch 311. This operation is performed until the next eight bits are inputted to the shift register 301. In this way, by performing the comparing operation of the data in the latches 308 and 310 with regard to the overall image area, the maximum value in the X direction of the original area remains in the latch 310 and the coordinate in the Y direction at this time remains in the latch 311. These values become the coordinates $P_2(X_2, Y_2)$.

An F/F 312 is set when the first eight bits indicative of white image are inputted for every main-scan line and is reset in response to a horizontal sync signal HSYNC. After this F/F 312 has been once set by the first eight bits representative of white image, it is held until the next HSYNC is generated. The value of the main-scan counter is set into a latch 313 when the F/F 312 is set and is loaded into a latch 314 during the interval until the next HSYNC is generated. This value is compared with the magnitude of the data in a latch 315 by a comparator 316. The maximum value in the X direction has been preset into the latch 315 when the VSYNC was generated. If the data in the latch 315 is larger than the data in the latch 314, an AND gate 317 will be made active, so that the data in the latch 314, and thus in latch 313, will be loaded into the latch 315. This operation is performed during the interval of the HSYNC and HSYNC. By performing the above-mentioned comparing operation with regard to the whole image area, the minimum value in the X direction of the original coordinates remain in the latch 315. This value becomes $X_3$. On one hand, when the AND gate 317 outputs a 1-signal, the value from the sub-scan counter is loaded into a latch 318. This value becomes $Y_3$.

Whenever the eight bits indicative of white image are inputted with respect to the whole image area, the values of the main-scan counter and of the sub-scan counter at that time are loaded into latches 319 and 320. Therefore, upon completion of the pre-scan of the original, the count values at the time when the last eight bits indicative of white image are inputted still remain in the counters. These values become the coordinates $P_4(X_4, Y_4)$.

The data lines of the above-mentioned eight latches (306, 311, 320, 318, 305, 310, 315, 319) are connected to a bus line BUS of the CPU, so that the CPU reads the data in those latches upon completion of the pre-scan. As shown in FIG. 4, the regions surrounded by the coordinates $X_3$, $X_2$, $Y_1$, and $Y_4$ among those data are discriminated as the area where the original exists.

The foregoing variable power mode will now be explained in detail. This variable power mode includes: a mode whereby the operator designates the same magnification in the main-scan and sub-scan directions; a mode whereby the operator designates two different magnifications in the main-scan and sub-scan directions; a mode whereby the same magnification is automatically calculated regarding the main-scan and sub-scan directions on the basis of the reading area of the original and of the paper size; and a mode whereby two different magnifications are automatically calculated regarding the main-scan and sub-scan directions. These modes are called U mode, UHP mode, A mode, and AHP mode sequentially from the first mode (in this case, U, A, H, and P are abbreviations of User selection, Auto selection, Horizontal, and Perpendicular, respectively). It is also assumed that the magnification in the main-scan direction is called $M_H$ and the magnification in the sub-scan direction is called $M_P$, and that those magnifications are represented by M when $M_H$ equals $M_P$.

Figures 2, 7:
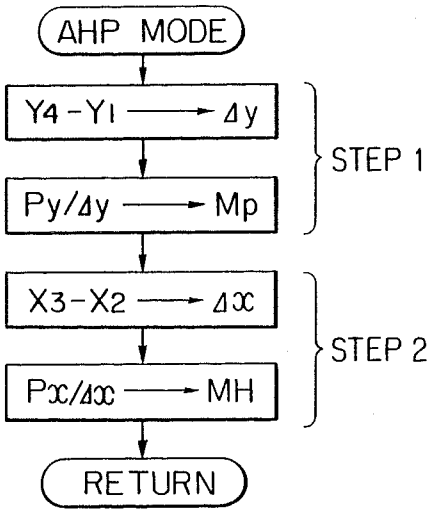
Figures 1, 7:
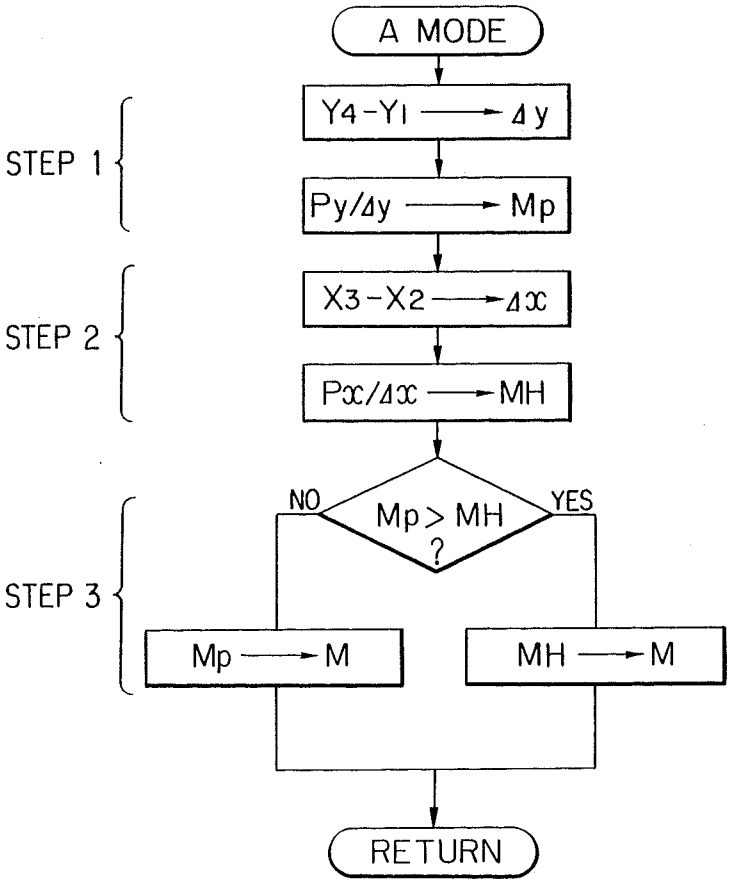

The A and AHP modes will be first explained. In these modes, the area obtained due to the foregoing automatic recognition is automatically variably magnified or reduced to a size that is fitted for the cassette sheet. That is, in the A mode, as shown in a flow chart in FIG. 7-1, the ratios $M_P=P_y/\Delta_y$ and $M_H=P_x/\Delta_x$ of the sizes in the Y and X directions of the original to the cassette sheet in the Y and X directions are obtained in steps 1 and 2. In step 3, the smaller ratio is set to the common magnification M regarding X and Y and is set into the RAM. Then, the foregoing variable power process is executed. Thus, the copy with the automatic variable power using one direction of the sheet as a reference is derived. In the AHP mode, as shown in FIG. 7-2 mentioned later, the respective ratios in the X and Y directions to the X and Y directions of the sheet are obtained, then the magnification $M_H$ in the X direction and the magnification $M_P$ in the Y direction are respectively independently set. Thus, an original image can be copied on the full sheet.

FIG. 6 shows a detailed diagram of the console section A-1 shown in FIG. 1. A numeral 205 denotes the seven-segment LED display to display a desired set copy quantity and to display a halfway copy quantity; 202 represents the alarm indicators to indicate paper jam, no toner, no paper, copy interruption, etc.; 204 indicators to indicate that the selected cassette is the upper or lower stage; 203 the indicators to indicate the size of paper enclosed in the cassette of the selected cassette stage; and 207 the ten-keys of 0 to 9 and C which are used to set the copy quantity to the display 205 and to designate the variable magnification on the display 206, and the like.

A numeral 208 denotes the clear and stop cancel key to stop the multi-copy of the printer; 201 the copy key to instruct the start of printing by the printer; 210 the cassette stage switching key; and 209 the mode key to select the variable power mode.

FIG. 7-2 shows a flow chart for explaining the AHP mode. Similarly to the A mode, in steps 1 and 2, the ratios $M_P$ and $M_H$ of the sizes in the X and Y directions of the original to the cassette sheet in the X and Y directions are obtained, respectively, and the process routine returns to execute the variable magnification in accordance with those ratios.

The magnification setting procedure will then be explained with reference to flow charts in FIGS. 8 and 9.

Figure 8A:
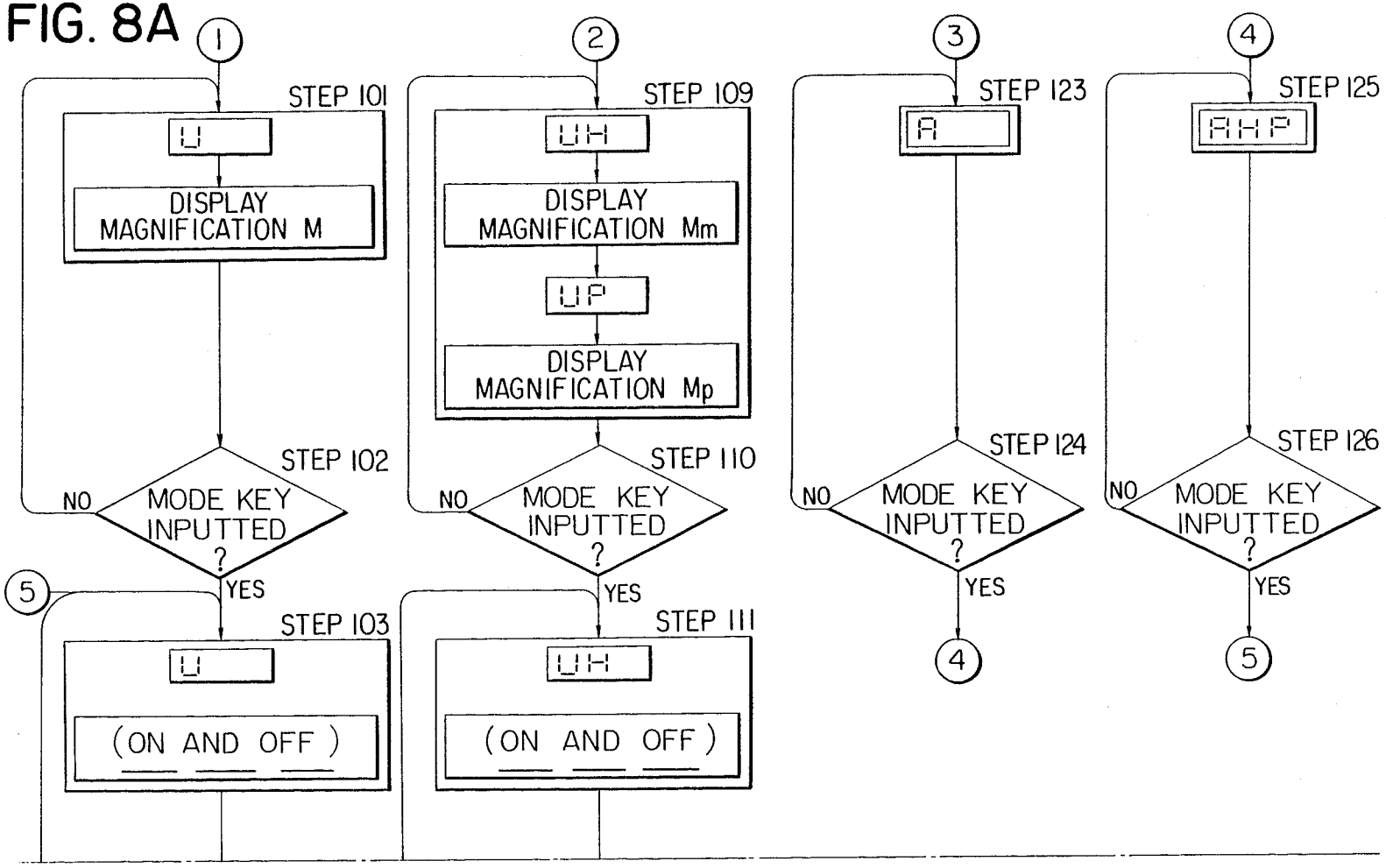
FIG. 8, composed of FIGS. 8A, 8B, and 8C, and FIG. 9 are flow charts showing a magnification display section.
Figures 8, 8B:
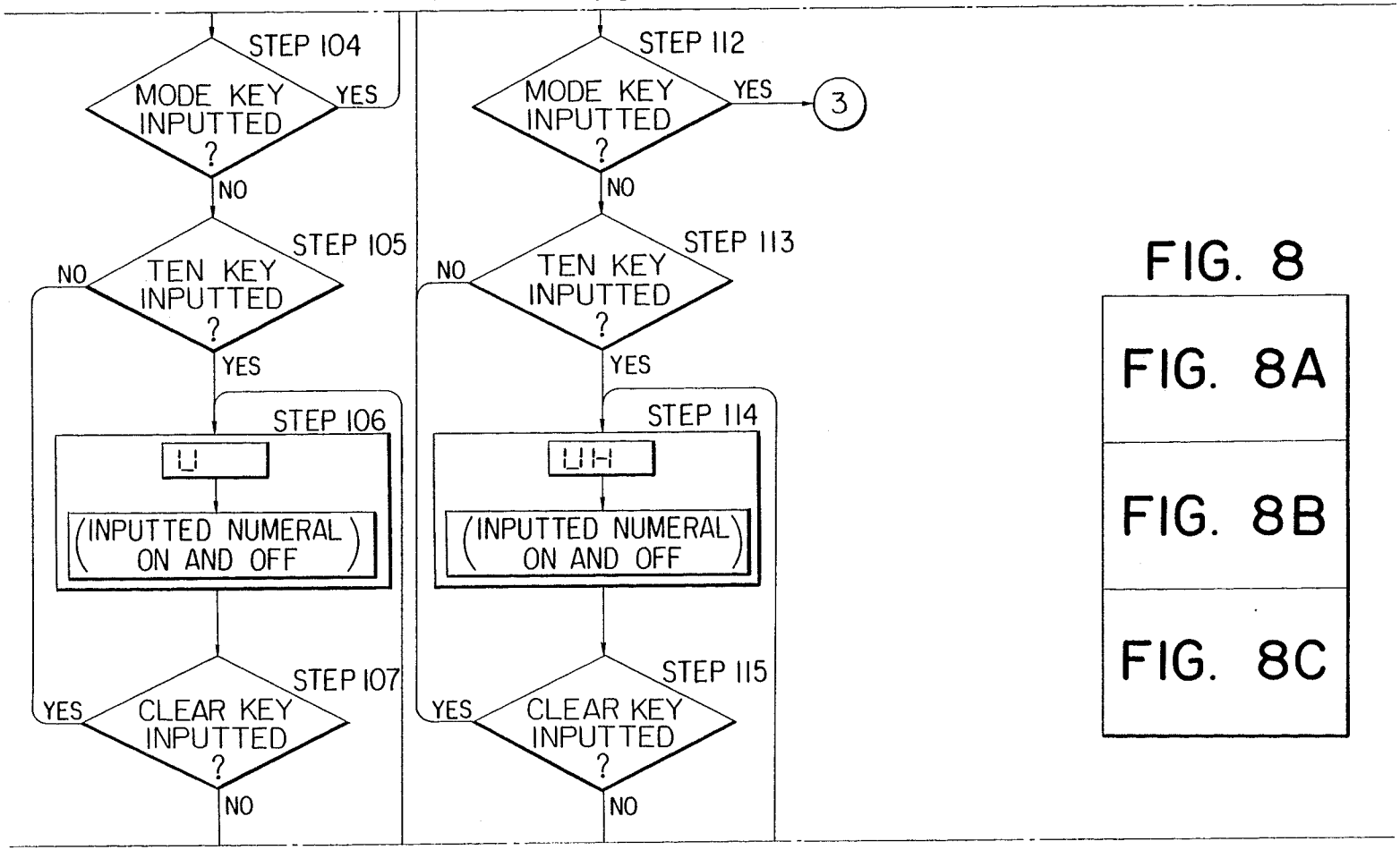
Figure 8C:
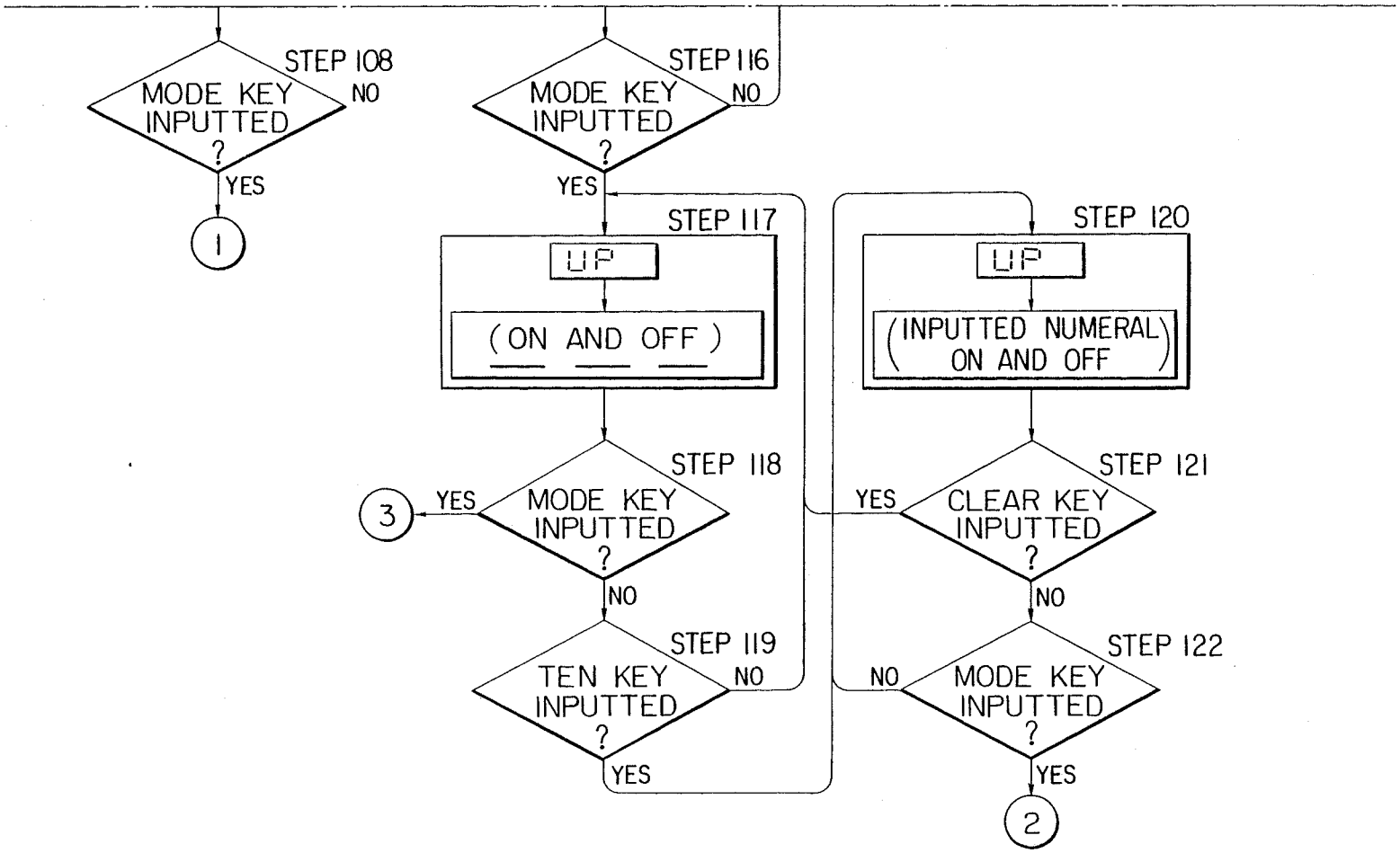
Figure 9:
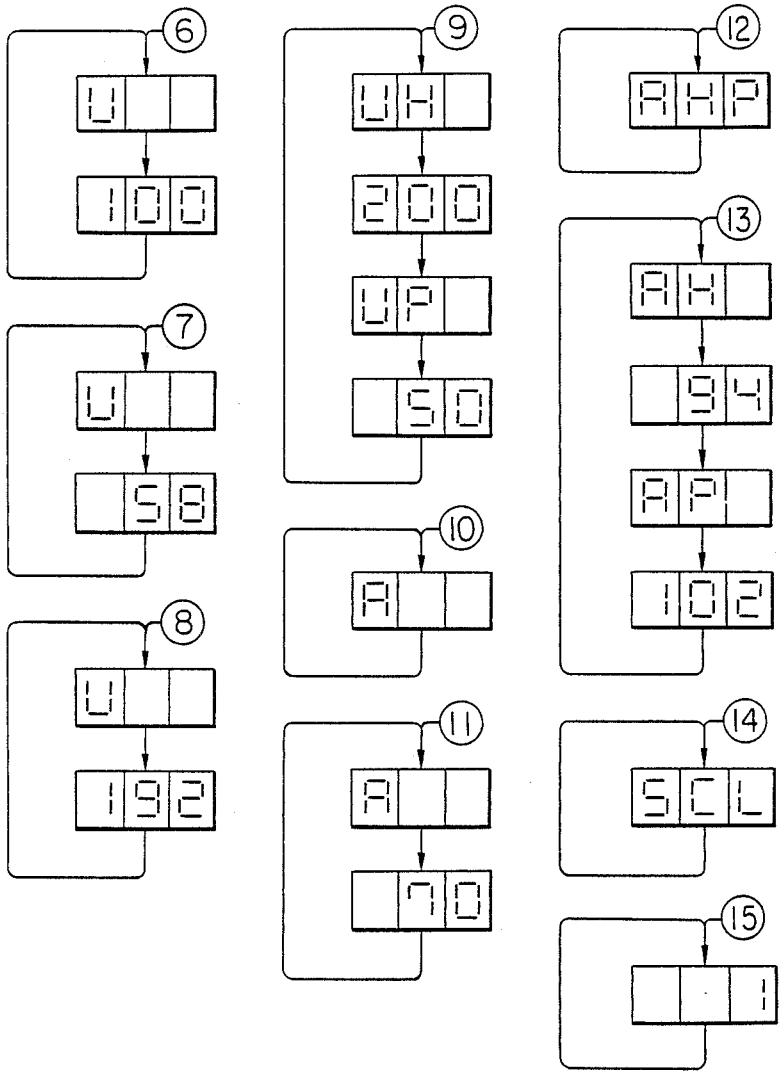

The variable power mode is set to the U mode and the magnification M is set to 100% due to the initialization when the power supply is turned on, so that "U" indicative of the U mode and the magnification of "100" are alternately and repeatedly displayed in the magnification display section as shown at ⑥ in FIG. 9. The respective display time intervals are not necessarily equal. This repetitive indication corresponds to step 101 in FIG. 8 and continues until the mode key is activated.

When the mode key is activated (step 102), three cursors (---) are flickeringly displayed in place of "100" representative of the magnification M. This flickering requests for the operator to input the key for determination of the variable power mode (step 103). Since the variable power mode is not decided during the flickering operation, the copy start key is not accepted, nor is the copying operation executed. In addition, since the 10-keys 207 are now to be used to determine the variable magnification, they cannot be used to set the copy quantity. Therefore, as shown at 14 in FIG. 9, "SCL" (SCALING) is displayed in the copy quantity display section to inform the operator of the above-mentioned fact.

If neither the mode key nor the ten-keys are used to, input new instructions, the stage of step 103 will be continued. If some ten-keys are operated (step 105), an indication of "U" and the inputted numerals will be repeatedly and alternately displayed flickeringly (step 106).

Next, if the clear key is operated, some inputted numeric values which are flickeringly being displayed will be cleared (step 107) and the process routine will return to step 103, thereby allowing the cursors to flicker. Similarly to the above, "SCL" is displayed in the magnification display section during the flickering operation, so that the start key input is not accepted and the copy quantity cannot be set at all. When the inputted numerals which are flickeringly being displayed are the desired value, the flickering operation is stopped by the mode key input and the magnification M is determined (step 108), then the process routine returns to ① in the flow chart. An example of step 101 in case of M=58% is shown at ⑦ in FIG. 9, while an example of step 101 in case of M=192% is shown at ⑧ in FIG. 9.

When the input magnification is decided, "SCL" displayed in the copy quantity display section disappears at ① in FIG. 8 and at ⑭ in FIG. 9 and the copy quantity is displayed as shown at, for instance, ⑮ in FIG. 9. In this way, the fact that the copy quantity can be set and the copying operation can be started is made known to the operator.

In step 104 in FIG. 8, when the U mode is not selected, the UHP mode is set by inputting the mode key again. At this time, the indication of "UH" and the flickering indication of the cursors are repeatedly and alternately displayed in the magnification display section in order to set the magnification $M_H$ in the main-scan direction of the UHP mode as indicated in step 111 in FIG. 8. In this case also, the copy quantity display section is as shown at ⑭ in FIG. 9. In the case of setting the UHP mode, if a desired magnification, e.g., "200", is inputted by the ten-keys (step 113) in the state specified in step 111, the flickering indication of the input value 200 and the indication of "UH" are repeatedly and alternately displayed as in step 114. In the case of correcting them, the clear key is operated. If they are correct, the mode key is operated (steps 115 and 116), then the magnification $M_P$ in the sub-scan direction in the UHP mode is set. The indication of "UP" and the flickering indication of the cursors are repeatedly and alternately displayed (step 117). Similarly to the above, when "50", for instance, is inputted as the magnification $M_P$ by the ten-keys (step 119), the indication of "UP" and the flickering indication of the input value of 50 are repeatedly and alternately displayed (step 120). When correcting them, the clear key is operated (step 121), so that the process routine returns to step 117. If they are correct, the mode key is operated (step 122), thereby finishing the set of the UHP mode. Then, step 109 at ② follows. For example, when 200;1 % is inputted as the $M_H$ and 50% is inputted as the $M_P$, the indications in step 109 become as indicated at ⑨ in FIG. 9, so that the operator can know that the magnification $M_H$ is "200" and the magnification of $M_P$ is 50 in the UHP mode. On the other hand, when the process routine reaches step 109, the copy quantity indication changes from ⑭ to ⑮ in FIG. 9, thereby informing the operator that the copy quantity can be set and that the copying operation can be started.

In step 112 or 118 in FIG. 8, in the case where there is no need to set the UHP mode or where the operator wants to stop the set of the UHP mode, the mode key is operated, and then the process routine advances to step 123.

In step 123, only "A" is displayed in the magnification display section as indicated at ⑩ in FIG. 9, thereby representing that the apparatus is set into the A mode. In the A mode, it is unnecessary for the operator to input a setting with the ten-keys, so that the display state in the copy quantity display section changes from ⑭ to ⑮ in FIG. 9 when the process routine reaches step 123, thereby informing the operator that the copy quantity can be set and that the copying operation can be started.

In the A mode, the length and breadth of the reading area are needed to calculate the magnification. Therefore, in general, "A" is continuously displayed as indicated at ⑩ in FIG. 9 until the original size information is obtianed by an original feed apparatus or due to the blank scan of a reader optical system. After the original size information is derived, the calculated magnification (e.g., 70) and "A" are repeatedly and alternately displayed as indicated at ⑪ in FIG. 9. However, in the case where the reading area of the original is preliminarily given by another means, the data as indicated at ⑪ in FIG. 9 will have already been displayed in step 123 in FIG. 8.

When the operator wants to set another mode in step 123, the mode key is operated (step 124) and the process routine advances to step 125. In step 125, the data as indicated at ⑫ in FIG. 9 is displayed, thereby representing that the apparatus is set into the AHP mode. At this time also, the copy quantity is displayed in the copy quantity display section as indicated at ⑮ in FIG. 9, thereby informing the operator that the copy quantity can be set and that the copying operation can be started.

In the AHP mode as well, the data is displayed as indicated at ⑫ in FIG. 9 until the size information of the reading area is obtained similarly to the case in the A mode. After the size information of the reading area is derived, when the magnifications $M_H$ and $M_P$ can be calculated, for instance, "94" and "102" are displayed as indicated at, e.g., ⑬ in FIG. 9 in order to inform that the $M_H$ magnification is 94% and the $M_P$ magnification is 102% in the AHP mode.

In the case where the reading area size is preliminarily known, the process routine advances from step 124 to step 125 in FIG. 8 and the data is immediately displayed as indicated at ⑬ in FIG. 9. If the operator wants to set another mode in step 126, the mode key is operated, so that step 103 will follow and the display to set the U mode will be performed.

Figure 10:
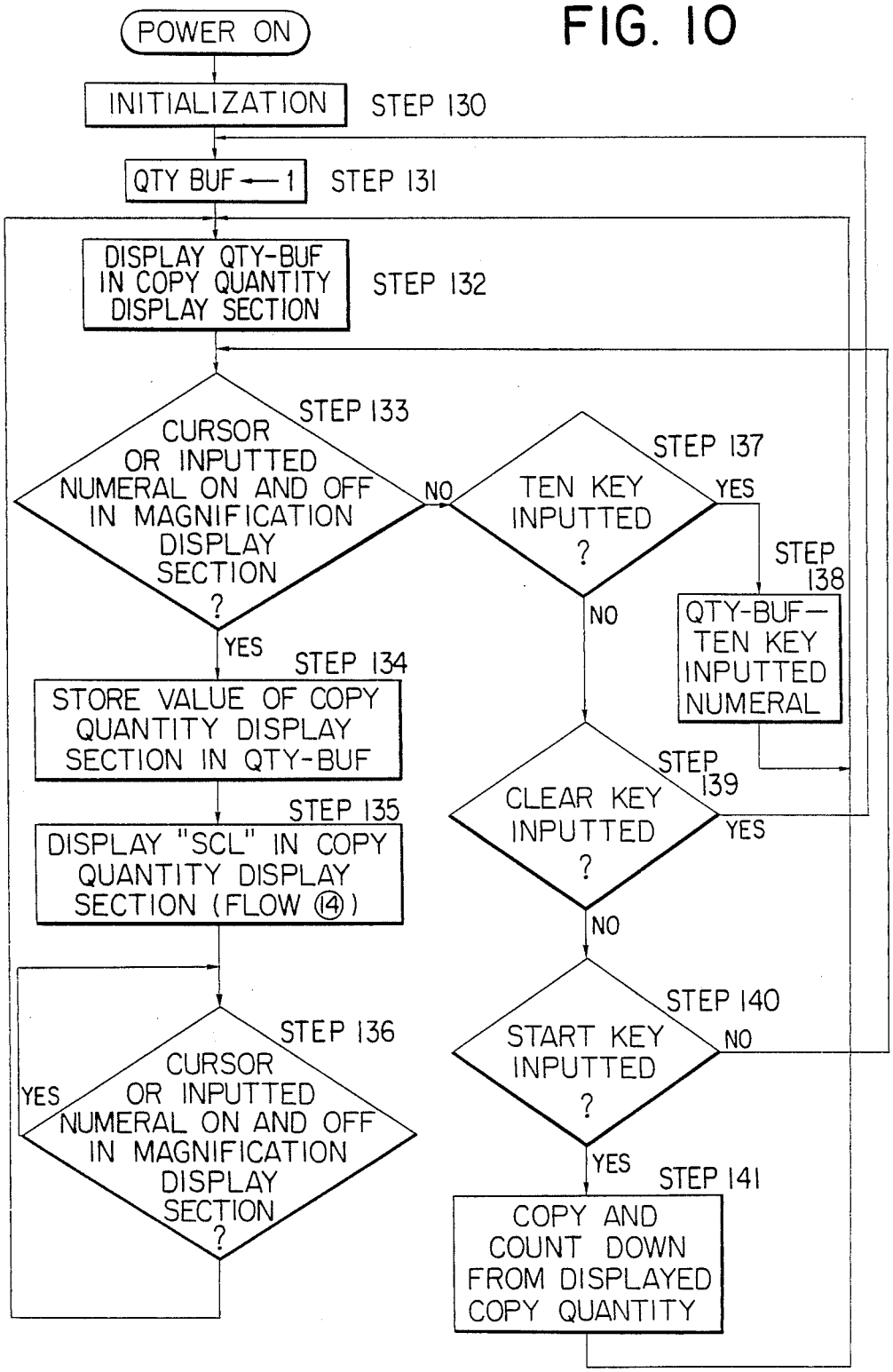
FIG. 10 is a flow chart showing a paper quantity display section.

Next, the display control in the copy quantity display section will be described with reference to FIG. 10. When the power supply is turned on, "1" is stored in a flag QTY-BUF in the RAM (step 131) in association with the ordinary initialization (step 130). This value "1" denotes the displayed copy quantity (step 132) upon initialization.

As mentioned before, when the variable power mode indication and the flickering indication of the cursors or inputted numeral are repeatedly displayed in the magnification display section, this means that the variable power mode is being set, so that the ten-key pad is used to set the magnification (step 133). Therefore, the copy quantity displayed in the copy quantity display section is stored in the flag QTY-BUF in the RAM (step 134), then "SCL" is displayed in the copy quantity display section (step 135 and at ⑭ in FIG. 9). After that, the apparatus waits for the completion of the set of variable power mode (step 136) and the process routine returns to step 132 and the copy quantity stored is again displayed. In step 133, the variable power mode is decided, a check is made to see if the ten-keys are inputted or not (step 137). If the answer is "yes" in step 137, the numeric value inputted by the ten-keys is adopted as the copy quantity and is displayed (steps 138 and 132).

The clear key is used to clear the inputted numeral indicative of the copy quantity (steps 139, 131, 132). Further, only at this time, the start key input is accepted (step 140) to perform the copy process. During the copying operation, the displayed copy quantity is counted down by one count value whenever the cop is performed once (step 141). After completion of the copying operation, the set copy quantity before copying is displayed (step 132).

As described above, the apparatus of the invention is not limited to the variable power mode, but also in an edit mode for such as trimming, masking or the like, the apparatus may have a display to display the inhibition of the start of copy, or data may be switched and displayed.

As described above, the user can easily grasp the state of the apparatus by indicating in the copy quantity indicator that the copy quantity cannot be set during the interval when a magnification is being set using the ten-keys.

In addition, according to the invention, it is possible to provide an operating apparatus having little display and key sections and with a good operability and extremely high functions.

On the other hand, in the mode setting process, the copy start key input is not accepted and the reason for it is displayed, thereby preventing vain attempts to start the image process. Also, by displaying the application for use of the keys which are used to set a plurality of data, the operability can be improved.

As described above, according to the invention, the respective data in the main-scan and sub-scan directions with respect to the magnification, trimming range and the like can be switched and displayed by a single display.

What is claimed is:

1. An image processing apparatus comprising:

input means for inputting information regarding image editing;

first display means for displaying numerical information indicating magnification corresponding to the information input by said input means;

second display means for displaying an image process quantity; and storing means capable of storing the image process quantity to be displayed by said second display means, wherein while said input means is inputting the magnification information, said second display means displays a message indicating that magnification is now being set and said image processing quantity which has been displayed by said second display means is stored, and wherein after setting the magnification, the image processing quantity which has been stored is again displayed by said second display means.

2. An image processing apparatus according to claim 1, wherein said input means comprises a set of ten keys and is capable of inputting data representing magnification after designation of a magnification mode by a designating means.

3. An image processing apparatus according to claim 1, wherein said first display means is capable of displaying magnification in main-scan and sub-scan directions so as to distinguish from each other.

4. An image processing apparatus according to claim 1, wherein said second display means is capable of displaying messages, and displays one of the messages indicating that the magnification are being set and that image process is not enabled, during the setting of the magnifications.

5. An image processing apparatus according to claim 1, wherein said storing means stores said image process quantity by using a flag.

6. An apparatus according to claim 1, further comprising:

scanning means for scanning an original document; and deriving means for deriving length data of the original document scanned by said scanning means in main-scan and sub-scan directions, wherein the numerical information indicating magnification displayed by said first display means includes symbolic information indicating either a manual mode in which magnification is set manually or an automatic mode in which magnification is set automatically on the basis of the length data derived by said deriving means.

7. An apparatus according to claim 6, wherein the automatic mode includes (1) a mode in which magnification in the main-scan direction and in the sub-scan direction are set independently of each other in response to the length data in each of the directions derived by said deriving means and (2) a mode in which magnification in the main-scan direction and in the sub-scan direction are set in common in response to the length data in each of the directions derived by said deriving means.

8. An image processing apparatus comprising:

input means for inputting data relating to an image process, the input data including at least image process quantity data and magnification data;

means for designating one of a plurality of magnification modes including at least (1) an automatic mode in which a magnification is set automatically, and (2) a manual mode in which a magnification is set manually;

first display means for displaying magnification in response to magnification data input by said input means;

second display means for displaying an image process quantity in response to image process quantity data input by said input means; and display control means for controlling said first and second display means such that while the magnification is being set by said input means, said first display means is displaying the magnification mode designated by said designating means and displaying the magnification in response to the magnification data input by said input means and said second display means is displaying a message representing that a magnification is now being set.

9. An image processing apparatus according to claim 8, wherein said input means comprises a set of ten keys and is capable of inputting numerical data representing magnification after designation of the magnification mode by said designating means.

10. An image processing apparatus according to claim 8, wherein said first display means is capable of displaying magnification in a main-scan and sub-scan direction so as to distinguish those magnifications from each other.

11. An image processing apparatus according to claim 8, wherein said second display means is capable of displaying messages, and displays a message indicating that the magnifications are being set and that image process is not enabled, during the setting of the magnifications.

12. An image processing apparatus according to claim 8, wherein said apparatus has a plurality of variable magnification modes in one of which the magnification in the main-scan direction and in the sub-scan direction can be set independently from each other and in another one of which the magnifications can be set commonly to each other, and wherein said first display means displays one of the plurality of variable magnification modes.

13. An apparatus according to claim 8, further comprising:

scanning means for scanning an original document; and deriving means for deriving length data of the original document scanned by said scanning means in main-scan and sub-scan directions, wherein the automatic mode includes (1) a mode in which magnification in the main-scan direction and in the sub-scan direction are set independently of each other in response to the length data in each of the directions derived by said deriving means, and (2) a mode in which magnification in the main-scan direction and in the sub-scan direction are set in common in response to the length data in each of the directions derived by said deriving means.

* * * * *

UNITED STATES PATENT AND TRADEMARK OFFICE

CERTIFICATE OF CORRECTION

PATENT NO. : 4,816,866

DATED : March 28, 1989

INVENTOR(S) : MASANORI YAMADA

It is certified that error appears in the above-identified patent and that said Letters Patent is hereby corrected as shown below:

COVER PAGE,

[57], line 2, "like." should read --like--.

COLUMN 2,

LINE 49, "A4 size)" should read --A4 size paper)--.

COLUMN 4,

LINE 3, "twoce" should read --twice--;

LINE 42, "carrier" should read --carried--.

COLUMN 7,

LINE 16, "stage" should read --state--.

COLUMN 8,

LINE 3, "200;1%" should read --200%--;

LINE 32, "obtianed" should read --obtained--.

COLUMN 10,

LINE 18, "distinguish from" should read --distinguish those magnifications from--;

LINE 22, "magnification" should read --magnifications--.

UNITED STATES PATENT AND TRADEMARK OFFICE

CERTIFICATE OF CORRECTION

PATENT NO. : 4,816,866

DATED : March 28, 1989

INVENTOR(S) : MASANORI YAMADA

It is certified that error appears in the above-identified patent and that said Letters Patent is hereby corrected as shown below:

COLUMN 11,

LINE 15, "magnification" should read --magnifications--

Signed and Sealed this

Twelfth Day of December, 1989

*Attest:*

JEFFREY M. SAMUELS

*Attesting Officer*

*Acting Commissioner of Patents and Trademarks*